US008125391B2

(12) United States Patent
Knudsen

(10) Patent No.: US 8,125,391 B2
(45) Date of Patent: Feb. 28, 2012

(54) MINIATURE PATCH ANTENNA

(75) Inventor: Ove Knudsen, Smørum (DK)

(73) Assignee: Oticon A/S, Smorum (DK)

( * ) Notice: Subject to any disclaimer, the term of this patent is extended or adjusted under 35 U.S.C. 154(b) by 386 days.

(21) Appl. No.: 12/413,381

(22) Filed: Mar. 27, 2009

(65) Prior Publication Data

US 2010/0171667 A1 Jul. 8, 2010

(30) Foreign Application Priority Data

Jan. 8, 2009 (EP) ..... 09 150234

(51) Int. Cl.
*H01Q 1/38* (2006.01)

(52) U.S. Cl. ..... 343/700 MS

(58) Field of Classification Search ..... 343/700 MS, 343/772; 333/239, 242, 248
See application file for complete search history.

(56) References Cited

U.S. PATENT DOCUMENTS

| | | | | |
|---|---|---|---|---|
| 4,827,271 | A | 5/1989 | Berneking et al. | |
| 5,955,995 | A | 9/1999 | Silverstein | |
| 6,943,731 | B2 | 9/2005 | Killen et al. | |
| 7,218,190 | B2 * | 5/2007 | Engheta et al. | 333/239 |
| 2008/0136734 | A1 | 6/2008 | Manholm et al. | |

FOREIGN PATENT DOCUMENTS

| | | | |
|---|---|---|---|
| EP | 1339132 | A1 | 8/2003 |
| EP | 1 876 670 | A1 | 1/2008 |
| WO | WO-2008/085552 | A2 | 7/2008 |

OTHER PUBLICATIONS

Alu et al., "Subwavelength, Compact, Resonant Patch Antennas Loaded with Metamaterials" vol. 55, No. 1, Jan. 2007, pp. 13-25. IEEE Transcations on Antennas and Propagation. XP011154652. ISSN: 0018-926X.

Petko et al., "Theoretical Formulation for an Electrically Small Microstrip Patch Antenna Loaded with Negative Index Materials" vol. 3B, Jul. 3, 2005, pp. 343-346. XP010860185, ISBN: 978-07803-8883-3.

Samir F. Mahmoud et al., "A new Miniaturized Annular Ring Patch Resonator Partially Loaded by a Metamaterial Ring with Negative Permeability and Permittivity" IEEE Antennas and Wireless Propagation Letters, vol. 3, No. 1, 2004, pp. 19-22. XP011182959, ISSN: 1536-1225.

Herraiz-Martinez et al., "Multifrequency and Dual-Mode Patch Antennas Partially Filled with Left-Handed Structures". IEEE Transcations on Antennas and Propagation, vol. 55, No. 8, Aug. 2008, pp. 2527-2539. XP011232479, ISSN: 0018-926X.

* cited by examiner

*Primary Examiner* — Hoang V Nguyen
(74) *Attorney, Agent, or Firm* — Birch, Stewart, Kolasch & Birch, LLP

(57) ABSTRACT

The invention relates to a patch antenna for a small size, low-power device adapted for transmitting or receiving electromagnetic radiation in a predefined frequency range. The invention further relates to a method of driving a patch antenna and to the use of a patch antenna. The object of the present invention is to provide a patch antenna suitable for a small size, low power device. The problem is solved in that the antenna comprises at least one patch comprising an electrically conductive material and having an upper and lower face, the at least one patch being supported on its lower face by an intermediate material comprising a material having a negative magnetic permeability and/or a negative electrical permittivity, at least over a part of the predefined frequency range. The present invention provides an alternative scheme for manufacturing a patch antenna for a small size, low power device. The invention may e.g. be used for establishing a wireless interface in a portable communication device.

19 Claims, 5 Drawing Sheets

MINIATURE PATCH ANTENNA

TECHNICAL FIELD

The present invention relates to antennas for relatively small, portable electronic devices. The invention relates specifically to a patch antenna for a small size, low-power device adapted for transmitting or receiving electromagnetic radiation in a predefined frequency range.

The invention furthermore relates to a method of driving a patch antenna.

The invention furthermore relates to use of a patch antenna in a portable communications device, e.g. a listening device, e.g. a hearing instrument.

The invention may e.g. be useful in applications such as for establishing a wireless interface in a portable communication device.

BACKGROUND ART

Performance degradations such as a lower efficiency and a narrower bandwidth are expected when the physical size of an antenna becomes much smaller than the operating wavelength. As this is the case for most antennas operating in hearing aids or in similar SRD (Short Range Device) applications it is of great importance to optimize the antenna efficiency in order to keep the power consumption low. This is equally important as minimizing the size, so improving the efficiency of the antennas used in size critical battery operated instruments will result in a decrease in power consumption and a longer battery life. Challenges of antenna miniaturization are e.g. reviewed by [Skrivervik et al., 2001].

Recently published work [Alù et al., 2007] has shown that introducing a meta-material in a patch antenna structure can lead to the realization of 35 electrically small patch antennas presenting an unprecedented good efficiency. The combination of a normal dielectric material and a meta-material as substrate between the patch and the ground plane can support a cavity resonance with a frequency which is much lower than what can be expected from a conventional design. In addition to the small dimensions of the resonant structure, which can also be achieved with a high permittivity dielectric material, the meta-material maintains good radiation efficiency. In contrast to the high permittivity dielectric material which traps most of the energy inside the material the meta-material sets up means to fulfil the resonant boundary conditions within small dimensions, and allows the electromagnetic fields to extend outside the structure.

DISCLOSURE OF INVENTION

The invention describes how this effect of minimizing the antenna size provided e.g. by the use of a meta-material can be exploited in size critical applications like hearing aids or similar body-worn SRDs. The term a 'short range device' (SRD) is in the present context taken to mean a device capable of communicating with another device over a relatively short range, e.g. less than 50 m, such as less than 20 m, such as less than 5 m, such as less than 2 m or in a sense as used in the ERC Recommendation 70-03, 30 May 2008 ([ERC/REC 70-03]). In an embodiment, an SRD according to the present invention is adapted to comply with [ERC/REC 70-03].

The present invention deals in particular with performance optimization of 25 antennas for wireless systems in hearing aids and similar size critical applications by utilizing a material (e.g. a meta-material) exhibiting a negative permeability $\mu$ (MNG) or permittivity $\in$ (ENG) or both (DNG) (at least in a part of the frequency range) in the design.

An object of the present invention is to provide a patch antenna suitable for a small size, low power device.

An object of the invention is achieved by a patch antenna for a small size, low-power device adapted for transmitting or receiving electromagnetic radiation in a predefined frequency range. The patch antenna comprises at least one patch comprising an electrically conductive material and having an upper and lower face, the at least one patch being supported on its lower face by an intermediate material comprising a material having a negative magnetic permeability and/or a negative electrical permittivity, at least over a part of the predefined frequency range.

The present invention provides an alternative scheme for manufacturing a patch antenna for a small size, low power device.

The term 'a small size device' is in the present context taken to mean a device whose maximum physical dimension (and thus of an antenna for providing a wireless interface to the device) is smaller than 10 cm, such as smaller than 5 cm. In an embodiment 'a small size device' is a device whose maximum physical dimension is much smaller (e.g. more than 3 times, such as more than 10 times smaller, such as more than 20 times small) than the operating wavelength of a wireless interface to which the antenna is intended (ideally an antenna for radiation of electromagnetic waves at a given frequency should be larger than or equal to half the wavelength of the radiated waves at that frequency). At 860 MHz, the wavelength in vacuum is around 35 cm. At 2.4 GHz, the wavelength in vacuum is around 12 cm. In an embodiment 'a small size device' is a listening device, e.g. a hearing instrument, adapted for being located at the ear or fully or partially in the ear canal of a user.

The term a 'low power device' is in the present context taken to mean an electronic device having a limited power budget, because of one or more of the following restrictions: 1) it has a local energy source, e.g. a battery, 2) it is a relatively small device having only limited available space for a local energy source, 3) it has to operate at low power because of system restrictions (maximum dissipation issues (heat), restrictions to radiated power for the wireless link, etc.). In an embodiment, a 'low power device' is a portable device with an energy source of limited duration, e.g. typically of the order of days (e.g. one or two days). In an embodiment, a 'low power device' is a portable device with an energy source of maximum voltage less than 5 V, such as less than 3 V.

In general the parameters (magnetic) permeability $\mu$ ($B=\mu\cdot H$) or (electric) permittivity $\in$ ($D=\in\cdot E$) are complex quantities, i.e. can be written as $\mu=\mu'+i\cdot\mu''$ and $\in=\in'+i\cdot\in''$, respectively, where $i^2=-1$ is the imaginary unit. The real parts ($\mu'$ and $\in'$) of the parameters relate to stored energy in the material and the imaginary parts ($\mu''$ and $\in''$) of the parameters relate to losses in the material. Typically values of p and E relative to their values in vacuum ($\mu_0$ and $\in_0$, respectively), termed $\mu_r$ and $\in_r$ are considered. The term 'having a negative magnetic permeability and/or a negative electrical permittivity, at least over a part of the predefined frequency range' is in the present context taken to mean that one or both of the parameters in question (magnetic) permeability $\mu$ or (electric) permittivity $\in$ has/have a negative real part at least over a part of the predefined frequency range.

In an embodiment, the patch antenna comprises a patch and a ground plane, where the intermediate material is located between the patch and the ground plane.

In an embodiment, the patch antenna comprises first and second patches separated by the intermediate material. This has the advantage that a relatively large ground plane conductor can be dispensed with, thereby rendering the antenna more suitable for small devices such as hearing aids. In an embodiment, the patches are arranged on each side of a constant width layer of the intermediate material. In an embodiment, the patches are arranged mirror symmetrically around a plane through the intermediate material. In an embodiment, the two patches are both supported by the intermediate material. In an embodiment, the first and second patches are identical in form, e.g. circular or polygonal (i.e. having a large degree of rotational symmetry around an axis perpendicular to the patch antenna sandwich structure).

In an embodiment, the intermediate material is inhomogeneous. In an embodiment, the intermediate material comprises a meta-material.

The term a 'meta-material' is in the present context taken to mean a composite material wherein a two or three dimensional cellular structure of (typically identical) structural elements is artificially introduced. In an embodiment, the meta-material is an anisotropic, e.g. uni-axial material, exhibiting a negative permeability μ (MNG) or permittivity ∈ (ENG) or both (DNG) in a frequency range.

In a particular embodiment, the patch antenna is adapted to provide that the second resonance $F_0$ is located in a frequency range ([$f_{min}$; $f_{max}$]) where the permeability μ (MNG) or permittivity ∈ (ENG) or both (DNG) of the intermediate material are negative.

In an embodiment, the intermediate material comprises first and second different materials, at least one being a material having a negative magnetic permeability and/or a negative electrical permittivity, at least over a part of the predefined frequency range. This has the effect that the patch antenna has two resonances, a first resonance ($F_1$) being governed by the form and size of the patch(es) (natural resonance), the second resonance ($F_0$) being dependent on geometrical relations between the first and second material (e.g. on the ratio of radii of first and second materials in a circular (annular) arrangement or the two materials, the first material constituting a cylinder with a first radius $r_1$, the second material surrounding the first material constituting a cylinder ring with an inner radius $r_1$ and an outer radius $r_2$). A major advantage of an antenna according to embodiments of the invention is that the second resonance frequency can be tailored and made independent of antenna size.

In an embodiment, the first and second different materials of the intermediate material have a common interface in the form of mutually touching or integrated faces. In an embodiment, the second material is arranged along the periphery of the patches and around the first material. In an embodiment the first and second materials have a common interface over an annular (e.g. circular or polygonal) section, e.g. in a slab-like structure where a centrally located body is surrounded by an annular, ring formed body. In an embodiment, the common interface constitutes a face perpendicular to the at least one patch, e.g. where the first and second materials are arranged in a layered structure with a common interface. In an embodiment, the common face is established as mixture of an annular and a layered arrangement of the two materials.

In an embodiment, the first material is selected from the group of materials having a negative magnetic permeability (MNG) and/or a negative electrical permittivity (ENG), and the second material is selected from the group of materials, for which the sign of at least one of the magnetic permeability and electrical permittivity is opposite to that or those of the first material.

In an embodiment, the first material is a meta-material. In an embodiment, the second material is a normal dielectric material or a meta-material.

In an embodiment, the first and second patches and the intermediate material are arranged in a structure having a high degree or rotational symmetry around an axis perpendicular to a face of the first and second patches, such as larger than 2, e.g. larger than or equal to 6, such as larger than or equal to 8, such as larger than or equal to 16, such as full rotational symmetry.

In an embodiment, the materials, their mutual arrangement, dimensions and form are optimized with respect to radiation and efficiency of the patch antenna.

In an embodiment, the patch antenna is adapted for transmission and/or reception in unlicensed ISM-like spectra (ISM=Industrial, Scientific and Medical) as e.g. defined by the ITU Radiocommunication Sector (ITU-R). In an embodiment, the patch antenna is adapted for transmission or reception in a frequency range around 865 MHz or around 2.4 GHz. In an embodiment, the patch antenna is adapted for transmission or reception in the range from 500 MHz to 1 GHz.

In an embodiment, the patch antenna is adapted to provide that the frequency range ([$f_{min}$; $f_{max}$]) around the second resonance frequency $F_0$ where the antenna is adapted to transmit or receive and where the permeability μ (MNG) or permittivity ∈ (ENG) or both (DNG) of the intermediate material is/are negative is larger than 1 MHz, such as larger than 10 MHz, such as larger than 50 MHz, such as larger than 100 MHz. In an embodiment, the patch antenna is adapted to provide that the frequency range ([$f_{min}$; $f_{max}$]) constitute at least 1% of the resonance frequency $F_0$, such as at least 5% of $F_0$, such as at least 10% of $F_0$. In an embodiment, the frequency range ([$f_{min}$; $f_{max}$]) around the second resonance frequency $F_0$ where the antenna is adapted to transmit or receive and where the permeability μ (MNG) or permittivity ∈ (ENG) or both (DNG) of the intermediate material is/are negative is defined as the range where the permeability μ (MNG) or permittivity ∈ (ENG) is smaller than or equal to −1, such as −2, such as −5.

In an embodiment, the patch antenna has dimensions that fit small portable devices, e.g. having maximum dimensions less than 25 mm, such as less than 10 mm. In an embodiment, the patch antenna is adapted to fit into a hearing instrument adapted to be worn at an ear or in an ear canal of a user.

A method of driving a patch antenna as described above in the section on mode(s) for carrying out the invention or in the claims is furthermore provided by the present invention. The method comprises that the first and second patches are driven by a balanced electrical signal.

In an embodiment, the method comprises that—when the device is in use—one of the patches is coupled to a nearby surface emulating a reference plane. In an embodiment, the nearby surface is the skin of a person.

Use of a patch antenna as described above in the section on mode(s) for carrying out the invention or in the claims in a portable communications device, e.g. a SRD, such as an RFID-device, or a listening device, e.g. a hearing instrument is moreover provided by the present invention. In an embodiment of the use, the first and second patches are driven by a balanced electrical signal. In an embodiment of the use, one of the patches is coupled to a nearby surface emulating a reference plane. In an embodiment, the nearby surface is the skin of a person.

A portable communications device is furthermore provided. The portable communications device comprises a patch antenna as described above in the section on mode(s) for carrying out the invention or in the claims and adapted to drive the patch antenna by a method as described above in the section on mode(s) for carrying out the invention or in the claims.

In an embodiment, the portable communications device comprises a battery (e.g. a rechargeable battery) for supplying energy to the device.

In an embodiment, the portable communications device comprises a hearing instrument.

A hearing instrument is additionally provided, the hearing instrument comprising an input transducer (e.g. a microphone) for converting an input sound to en electric input signal, a signal processing unit for processing the input signal according to a user's needs (e.g. providing a frequency dependent gain) and providing a processed output signal and an output transducer (e.g. a receiver) for converting the processed output signal to an output sound for being presented to a user. The hearing instrument further comprises a wireless interface for communicating with another communication device (e.g. a mobile telephone), the wireless interface comprising a transceiver coupled to a patch antenna as described above, in the section on mode(s) for carrying out the invention or in the claims and adapted to drive the patch antenna by a method as described above in the section on mode(s) for carrying out the invention or in the claims.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise.

Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1A:
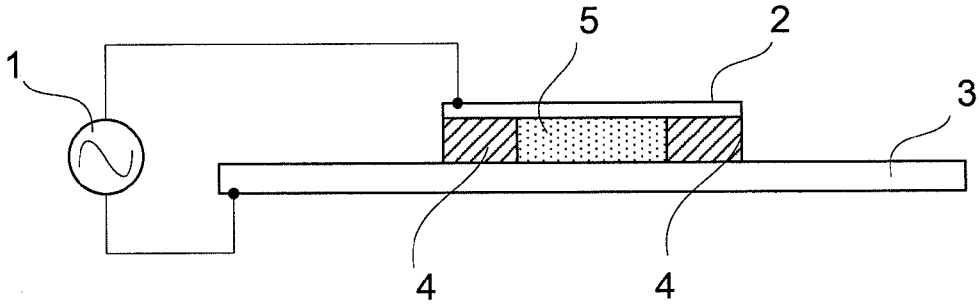
FIG. 1 shows an embodiment of a patch antenna according to the invention, the antenna comprising a patch and a ground plane.
Figure 1B:
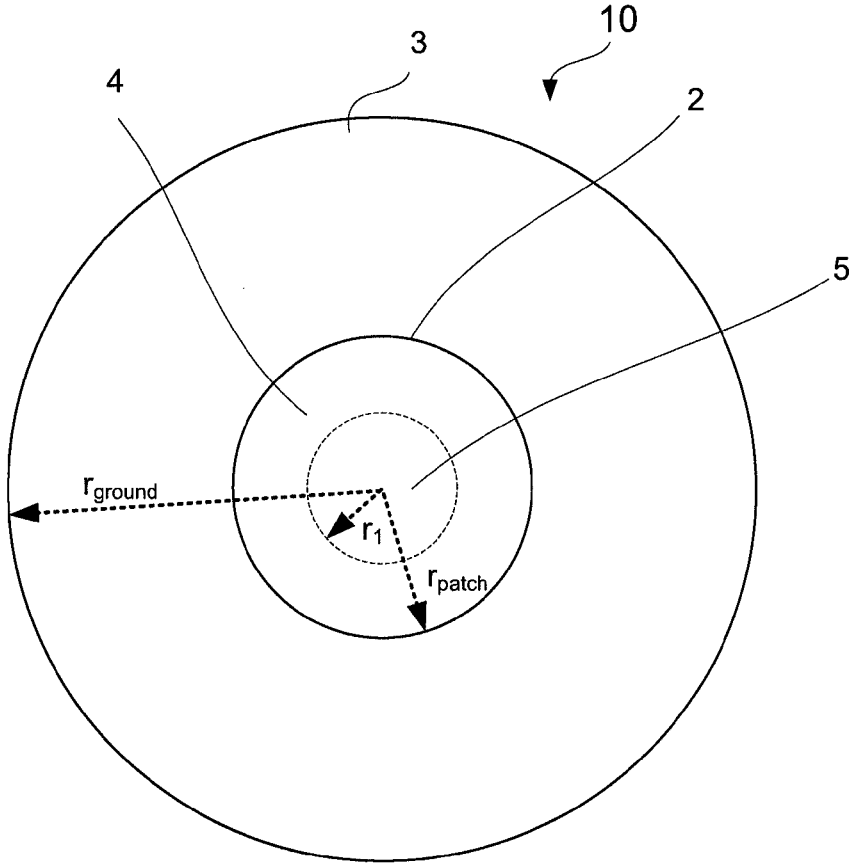

FIG. 1 shows an embodiment of a patch antenna according to the invention, the antenna comprising a patch and a ground plane.

A patch antenna 10 as shown in FIG. 1 requires a ground plane 3, which is large compared to the patch 2 and therefore typically cannot—due to size limitations—be realized in a small device such as a hearing aid. The patch antenna of FIG. 1*a* (side view of antenna with driving circuit) and 1*b* (top view of antenna) comprises a circular patch 2 centred relative to a larger circular ground plane 3 both comprising an electrically conductive material such as Cu (or Ag or Au). The patch 2 and the ground plane 3 are separated by an intermediate layer comprising two different materials: An outer ring 4 of a normal dielectric material (e.g. a polymer material, such as 'FR4' or polytetrafluoroetylen (PTFE), or a material optimized to having a relatively low epsilon (permittivity) and a relatively low loss) and a centrally located part 5 of a meta-material filling out the space not occupied by the normal dielectric materiel. The meta-material and the normal dielectric material could alternatively be mutually switched so that the meta-material constituted the outer ring 4 and the normal dielectric material constituted the remaining 35 central part 5. The meta-material is adapted to have a negative permeability and/or a negative permittivity in at least a part of the intended frequency range of the antenna. The antenna 10 is driven by a transceiver 1 (e.g. comprising a relatively high frequency carrier signal modulated with an audio signal or a signal modulated according to digital specification, e.g. Bluetooth). In an embodiment, the antenna is optimized for transmission and/or reception in a frequency range between 500 and 1000 MHz, e.g. around 860 MHz. The patch antenna of FIG. 1 comprises a circular patch of a radius $r_{patch}$ of 20 mm and a ground plane of a radius $r_{ground}$ of 30 mm and an intermediate layer of thickness 5.5 mm separating the patch and ground plane. In the embodiment shown in FIG. 1, the intermediate layer has a constant thickness and the same form and extension as the patch, i.e. a circular slab of radius $r_{patch}$. Alternatively, the intermediate lay may have the same extension as the ground plane or an extension between those of the patch and ground plane. The intermediate layer comprises in the embodiment of FIG. 1 a centrally located circular slab of a radius $r_1$ 10 mm of a first material having a negative real part of the permeability in a 1-50 MHz band around 500 MHz. The centrally located circular slab 5 is surrounded by a ring 4 of a normal dielectric material (e.g. a polymer) with an outer radius $r_2=r_{patch}$ of 20 mm. The patch construction of the embodiment of FIG. 1 is circular. It may, alternatively take on other forms appropriate for the application in question, such as polygonal, e.g. a pentagon or a hexagon or a polygon of a larger rotational symmetry.

Figure 2:
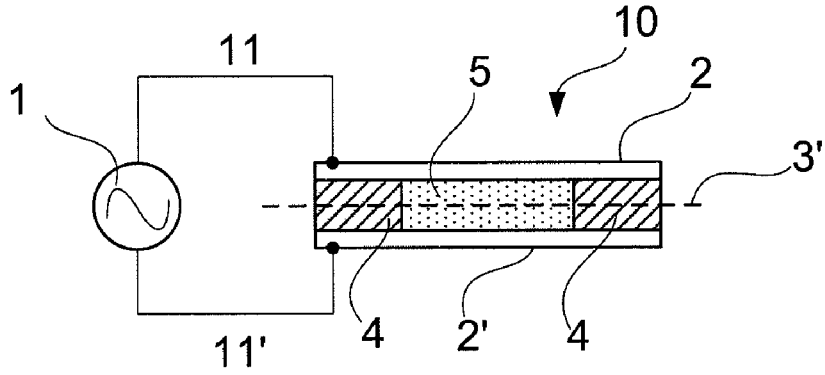
FIG. 2 shows an embodiment of a patch antenna according to the invention, the antenna comprising opposed, mirrored patches.

FIG. 2 shows an embodiment of a patch antenna according to the invention, the antenna comprising opposed, mirrored patches.

A preferred embodiment of the patch antenna 10 avoiding the use of a ground plane larger than the top patch (FIG. 1) is shown in FIG. 2. The antenna 10 comprises a mirror 2' of the (top) patch 2 and creates a virtual ground plane 3' between the patches 2, 2'. By feeding the mirrored structure with a balanced signal 11, 11' (i.e. the signal 11' applied to the lower patch 2' being the inverse of the signal 11 applied to the top patch 2) from transceiver 1, the symmetry plane will coincide with the virtual ground plane 3' and in that way the benefits and conclusions drawn from the single ended patch above a physical ground plane can be transferred to the balanced implementation. The balanced structure maintains the small dimensions and can fit into a size-critical device like a hearing aid. In an embodiment, the patch antenna is adapted for transmission/reception in the frequency range from 500 MHz to 1000 MHz. Again, a construction of the layer supporting the patches comprises an outer ring 4 of a normal dielectric material and a centrally located part 5 of a meta-material having a negative permeability or permittivity in the intended frequency range filling out the space not occupied by the normal dielectric materiel. Alternatively the materials may be oppositely located. The frequency range is optimized by adapting the (lower) resonance frequency of the patch antenna in dependence of the ratio of the radius $r_1$ of the central part 5 to the outer radius $r_2$ of the ring 4. The dimensions of the antenna are the following: patch diameter 20 mm (=outer diameter of the normal material), diameter of meta-material 10 mm, thickness of layer between patches 11 mm.

Figure 3:
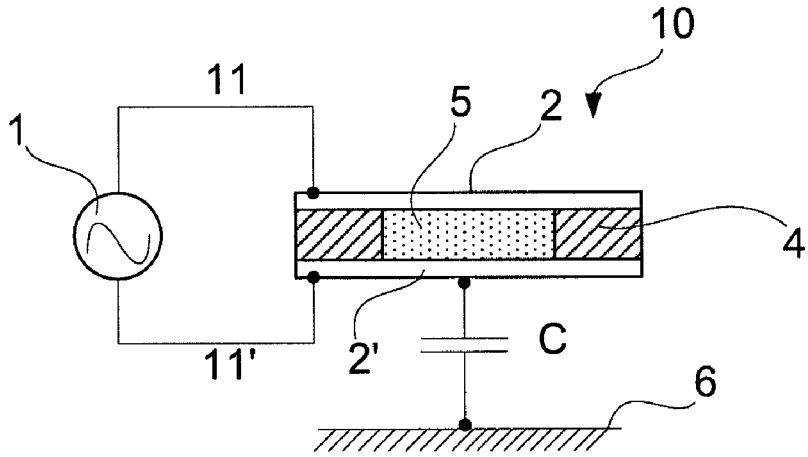
FIG. 3 shows an embodiment of a patch antenna according to the invention, the antenna comprising opposed, mirrored asymmetrically coupled patches.

An alternative solution is to make the ground plane the same size as the top patch and make it couple closely to a nearby surface (e.g. to the body or head of a person) to emulate a large reference plane. This is illustrated in FIG. 3. FIG. 3 shows an embodiment of a patch antenna according to the invention, the antenna comprising opposed, mirrored asymmetrically coupled patches. The embodiment shown in FIG. 3 is identical to the one shown in FIG. 2 apart from the coupling of one of the patches 2' to the nearby surface 6. A close coupling means that the impedance Zp between the patches 2, 2' is much higher than the impedance Z'gnd between the patch 2' and the nearby surface 6 as illustrated by capacitor C and as shown on the equivalent diagram of FIG. 4. Preferably, the same impedance Zgnd between the 'upper' patch 2 and the nearby surface 6 is much larger than the impedance Z'gnd between the 'lower' patch 2' and the nearby surface (abs(Z'gnd)<<abs(Zgnd)). Also, in this case the small dimensions are maintained and a balanced feed of the antenna makes it feasible to couple either side of the patch to the ground plane and equal radiation performance in the two situations can be accomplished due to the full image symmetry of the physical device.

Figure 4:
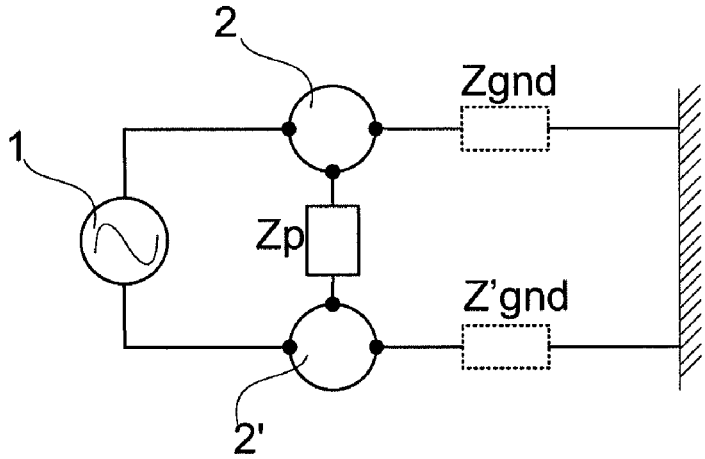
FIG. 4 shows an equivalent diagram of the asymmetrical coupling of the embodiment shown in FIG. 3.

FIG. 4 shows an equivalent diagram of the asymmetrical coupling of the embodiment shown in FIG. 3. The large difference in the coupling impedances Z'gnd and Zgnd depends basically on the relative positions of the nearby surface 6 and the antenna structure. Z'gnd in FIG. 4 represents the impedance of the capacitor C in FIG. 3 and Zgnd represents the much larger impedance between the upper patch 2 and the surface 6 in FIG. 3.

Figure 5A:
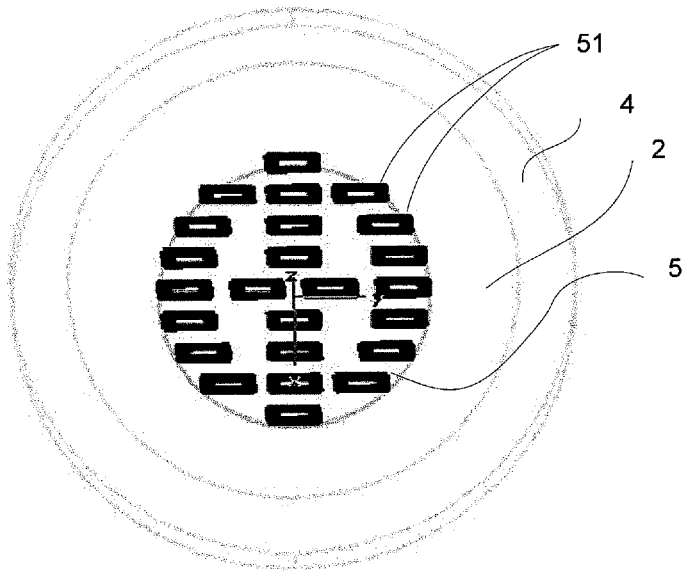
FIG. 5 shows a schematic illustration of a meta-material for use in a patch antenna according to an embodiment of the invention.
Figure 5B:
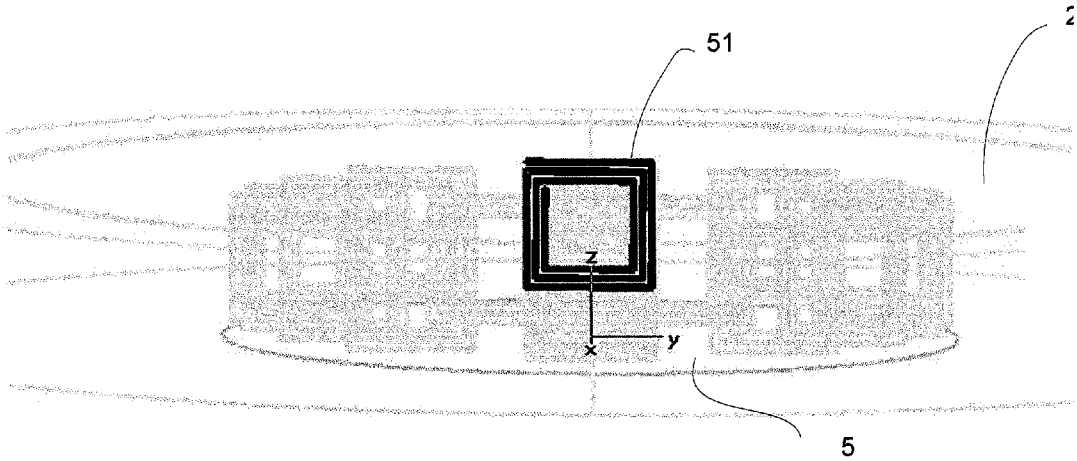
Figure 5C:
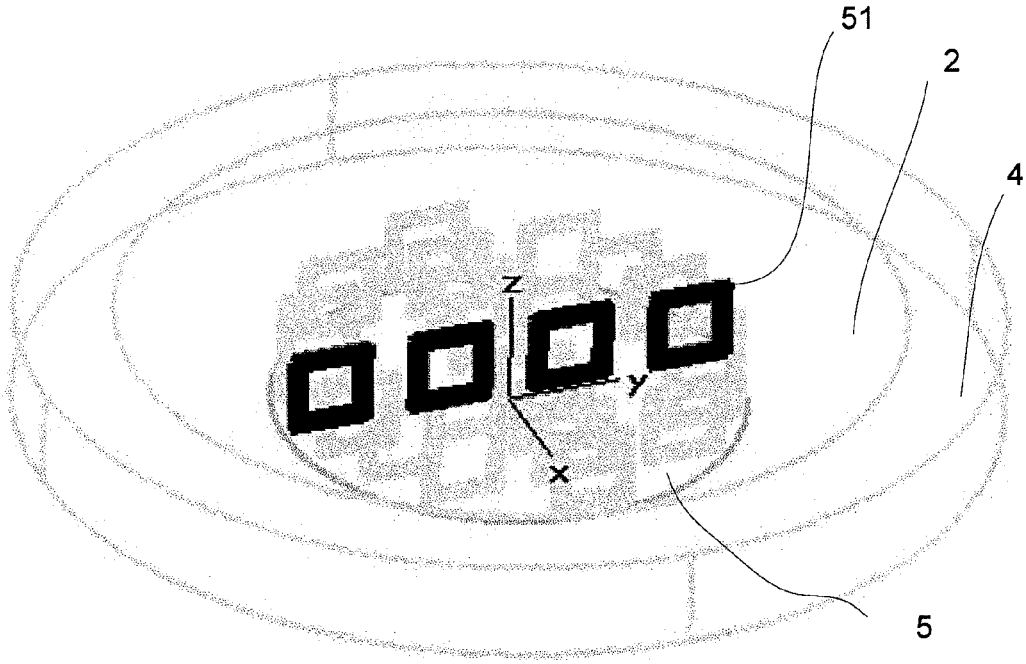

FIG. 5 shows a schematic illustration of a meta-material for use in a patch antenna according to an embodiment of the invention. FIG. 5 shows a patch antenna as also shown and discussed above in connection with FIG. 1. The numbers on the figures correspond and the only difference is that the normal dielectric material 4 is extended from the circumference of the patch in FIG. 1 to the circumference of the ground plane in FIG. 5. FIG. 5*a* shows a transparent schematic top view of an embodiment of a patch antenna according to the invention. The centrally located meta-material 5 is shown to comprise an array of identical structural elements 51. In the present embodiment, structural elements 51 are (planar) coil formed elements, comprising wires of a conductive (metallic) material. The (second) resonance frequency $F_0$ of the antenna is determined by the structure and arrangement of these elements (their 3D-pattern, their density (mutual distance), number of coil turns, width of wires, distance between wires, wire length, properties of the metal (including its thickness and resistivity) and the electromagnetic properties of the surrounding material, e.g. the dielectric material (including its permittivity), etc. (cf. e.g. [Bilotti et al., 2007] for multiple split ring and spiral structural elements). The material can e.g. be manufactured by a planar sandwiching technique by embedding an array of coils in a layer of a typically dielectric substrate, e.g. a printed circuit board (PCB) within a specific area (e.g. within a circle of radius $r_1$). The dimensions of and mutual distance $d_{se}$ of the structural elements (here planar coils) are preferably small compared to the wavelength $\lambda_a$ of the electromagnetic field which to the antenna is optimized. In an embodiment, $d_{se}<0.5\cdot\lambda_a$, such as $d_{se}<0.1\cdot\lambda_a$, such as $d_{se}<0.05\cdot\lambda_a$, such as $d_{se}<0.01\cdot\lambda_a$, such as $d_{se}<0.005\cdot\lambda_a$, such as $d_{se}<0.001\cdot\lambda_a$. A number of identical layers (such as 2 or 3 or more, e.g. 5-10, e.g. 8 as in the embodiment of FIG. 5*a*) are then stacked to form a layered structure of thickness $T_{inter}$ equal to (constituting) the thickness of the intermediate material between the two patches. The 'outer' part of the sandwich structure, wherein no structural elements are embedded (i.e. comprising layers of identical PCB-substrates), may conveniently constitute the second material of the patch antenna (here a normal dielectric material constituting the PCB). If a metallic layer is applied to both planar faces of the layered structure, a patch antenna according to the invention is formed, whose outer (radial) limits can be appropriately formed to be circular or polygonal or any other form fitting the application in question. FIGS. 5*b* and 5*c* show schematic side and perspective views of the patch antenna.

A meta-material for use in connection with the present invention can e.g. be manufactured as described in [Bilotti et al., 2007]. Technologies suitable for manufacturing meta-materials include planar technologies, such as semi-conductor or PCB technologies (using alternate masking and deposition steps) and/or combinations of other deposition techniques (e.g. plasma or vacuum deposition or sputtering).

Figure 6A:
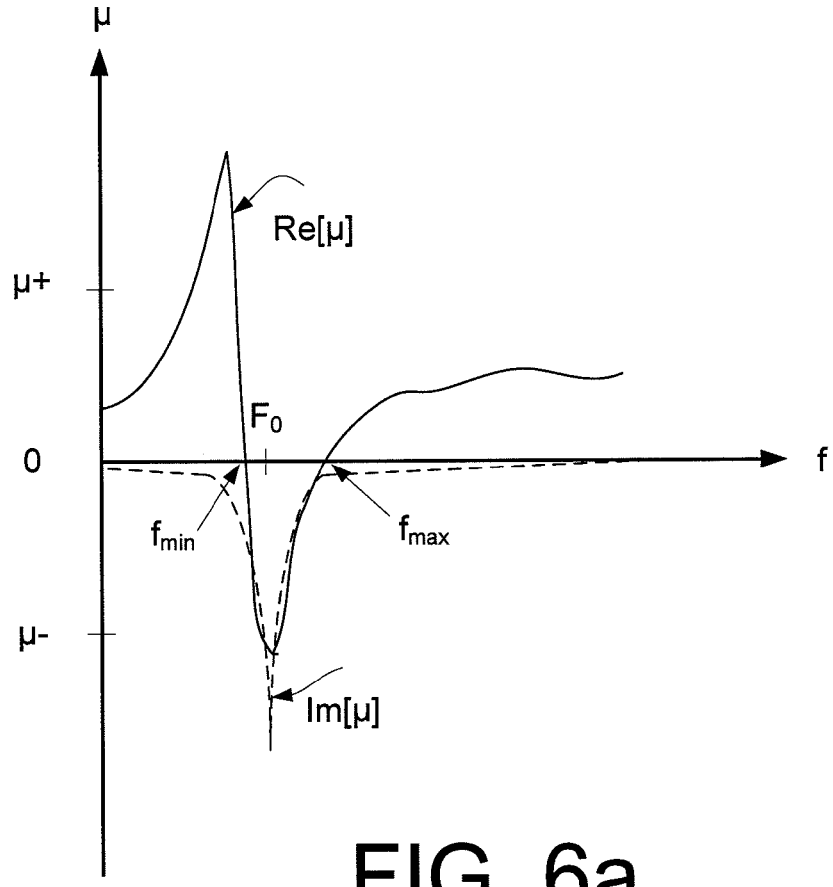
FIG. 6 shows corresponding schematic frequency dependence of real and imaginary parts of permeability μ (FIG. 6*a*) for a first material and reflection coefficient or return loss RL (FIG. 6*b*) of a patch antenna according to the invention.
Figure 6B:
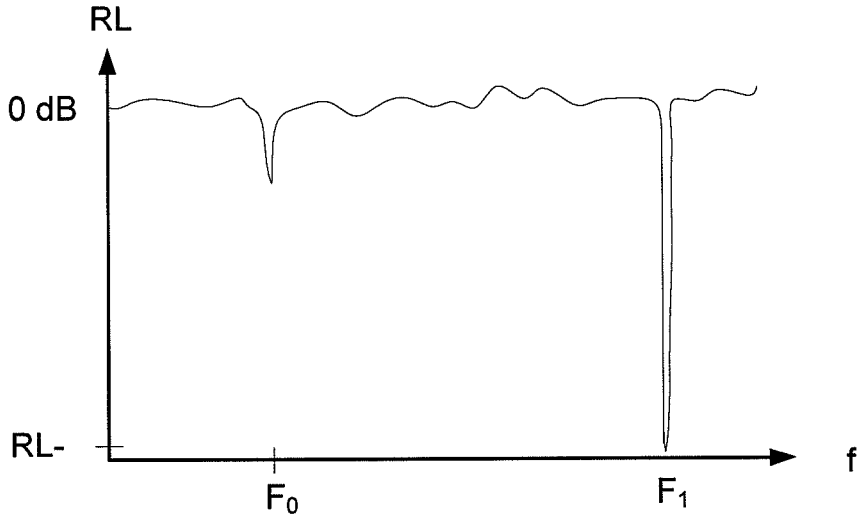

FIG. 6 shows corresponding schematic frequency dependence of real and imaginary parts of permeability μ (FIG. 6*a*) for a first material and reflection coefficient or return loss RL (FIG. 6*b*) of a patch antenna according to the invention. FIG. 6*a* shows the real and imaginary parts of the magnetic permeability for a material having a negative magnetic permeability in a frequency range between a minimum frequency $f_{min}$ and a maximum frequency $f_{max}$ located on each side of a resonance frequency $F_0$ of the antenna. In a patch antenna constructed as described above in connection with FIGS. 1, 2, 3, 5, this has the effect that the patch antenna has two resonances (cf. FIG. 6*b*), a first resonance $F_1$ being governed by the form and size of the patch(es) (natural resonance), and a second resonance $F_0$ being dependent on geometrical relations between the first and second material (e.g. on the ratio of radii of first and second materials in a circular (annular)

arrangement or the two materials, the first material constituting a cylinder with a first radius $r_1$, the second material surrounding the first material constituting a cylinder ring with an inner radius $r_1$ and an outer radius $r_2$). The real part of the magnetic permeability Re[μ] is negative between $f_{min}$ and $f_{max}$ and positive outside this range. In an embodiment, the second resonance $F_0$ is located between 500 MHz and 800 MHz, e.g. around 500 MHz. In an embodiment, the scale of FIG. 6*a* is such that the indicated levels μ+ and μ− are of the order of +5 to +10 and −5 to −10, respectively, so that the absolute of the peak values of the real and imaginary parts are between 10 and 20. FIG. 6*b* schematically shows return loss RL vs. frequency f and illustrating the first and second resonances $F_1$ and $F_0$. In an embodiment, $F_1$ is 3-5 times $F_0$. In an embodiment, $F_1$ is in the GHz-range, e.g. between 1 GHz and 5 GHz, e.g. around 2.5 GHz. In an embodiment, the scale factor RL− in FIG. 6*b* is of the order of −20 dB to −40 dB.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Alù et al., 2007] A. Alù, F. Bilotti, N. Engheta, and L. Vegni, "Subwavelength, Compact, Resonant Patch Antennas Loaded with Metamaterials". IEEE Transactions on Antennas and Propagation, Vol. 55, No. 1, January 2007, pp. 13-25.

[Bilotti et al., 2007] Filiberto Bilotti, Alessandro Toscano, Lucio Vegni, Koray Aydin, Kamil Boratay Alici, and Ekmel Ozbay "Equivalent-Circuit Models for the Design of Metamaterials Based on Artificial Magnetic Inclusions", IEEE Transactions on Microwave Theory and Techniques, Vol. 55, No. 12, December 2007, pp. 2865-2673.

[ERC/REC 70-03], ERC Recommendation 70-03 relating to the use of short range devices (SRD), version of 30 May 2008.

[Skrivervik et al., 2001] A. K. Skrivervik, J.-F. Zurcher, O. Staub, J. R. Mosig, "PCS Antenna Design: The Challenge of Miniaturization", IEEE Antennas and Propagation Magazine, Vol. 43, No. 4, August 2001, pp. 12-27.

The invention claimed is:

1. A patch antenna for a small size, low-power device adapted for transmitting or receiving electromagnetic radiation in a predefined frequency range, comprising:

at least one patch comprising an electrically conductive material and having an upper and lower face, the at least one patch being supported on its lower face by an intermediate material including first and second different materials, at least one being a material having a negative magnetic permeability μ and/or a negative electrical permittivity ∈, at least over a part of the predefined frequency range, wherein the patch antenna has a first resonance frequency and a second resonance frequency, the first resonance frequency is governed by the form and size of the at least one patch, the second resonance frequency is based on geometrical relations between the first and second different materials, and the second resonance frequency is in a frequency range where the magnetic permeability μ or electrical permittivity ∈, or both, of the intermediate material are negative.

2. A patch antenna according to claim 1 comprising a patch and a ground plane, where the intermediate material is located between the patch and the ground plane.

3. A patch antenna according to claim 2 wherein the patches are arranged on each side of a constant width layer of the intermediate material.

4. A patch antenna according to claim 2 wherein the patches are arranged mirror symmetrically around a plane through the intermediate material.

5. A patch antenna according to claim 1 comprising first and second patches separated by the intermediate material.

6. A patch antenna according to claim 5 wherein the first and second patches and the intermediate material are arranged in a structure having a high degree of rotational symmetry around an axis perpendicular to a face of the first and second patches, the high degree of rotational symmetry being larger than 2.

7. A method of driving a patch antenna according to claim 5, wherein the first and second patches are driven by a balanced electrical signal.

8. A method according to claim 7 wherein—when the device is in use—one of the patches is coupled to a nearby surface emulating a reference plane.

9. A portable communications device comprising a patch antenna device according to claim 5 adapted to drive the patch antenna by a method by which the first and second patches are driven by a balanced electrical signal.

10. A patch antenna according to claim 1, wherein the frequency range around the second resonance frequency is defined as the range where the permeability μ or permittivity ∈ is smaller than or equal to −1.

11. A patch antenna according to claim 10 wherein the first and second different materials of the intermediate material have a common interface in the form of mutually touching or integrated faces.

12. A patch antenna according to claim 10 comprising first and second materials, the first being selected from the group of materials having a negative magnetic permeability (MNG) and/or a negative electrical permittivity (ENG), the second being selected from the group of materials for which the sign of at least one of the magnetic permeability and electrical permittivity is opposite to that or those of the first material.

13. A patch antenna according to claim 12 wherein the first material is a meta-material and/or the second material is a normal dielectric material or a meta-material.

14. A patch antenna according to claim 10 wherein the second material is arranged along the periphery of the patches around the first material, e.g. so that the second material is arranged annually around the first material.

15. A patch antenna according to claim 10 wherein the first and second material are arranged on top of each other in a layered structure.

16. Use of a patch antenna according to claim 1 in a portable communications device, e.g. a SRD, such as an RFID-device, or a listening device, e.g. a hearing instrument.

17. Use according to claim 16 wherein the antenna comprises first and second patches driven by a balanced electrical signal.

18. Use according to claim 16 wherein the antenna comprises first and second patches and one of the patches is coupled to a nearby surface emulating a reference plane.

19. A hearing aid comprising a patch antenna according to claim 1.

* * * * *